United States Patent [19]

Baumann et al.

[11] 4,286,515

[45] Sep. 1, 1981

[54] COMPACTING WASTE BASKET

[75] Inventors: Manfred Baumann, Diepoldsau, Switzerland; Wolfgang Lohmann, Wiesbaden, Fed. Rep. of Germany

[73] Assignee: Apura GmbH & Co., Mainz-Kostheim, Fed. Rep. of Germany

[21] Appl. No.: 96,271

[22] Filed: Nov. 21, 1979

[30] Foreign Application Priority Data

Nov. 24, 1978 [DE] Fed. Rep. of Germany ..... 2850959

[51] Int. Cl.[3] ..... B30B 15/06

[52] U.S. Cl. ..... 100/233; 100/172; 100/176; 100/209; 100/220; 100/265; 100/266; 100/245; 100/295; 220/262

[58] Field of Search ..... 220/262; 53/537; 100/265, 266, 226, 233, 227, 228, 240, 265, 209, 172, 176, 245, 295

[56] References Cited

U.S. PATENT DOCUMENTS

| | | | |
|---|---|---|---|
| 3,357,346 | 12/1967 | Crafoord | 100/265 X |
| 3,386,374 | 6/1968 | Tezuka | 100/233 X |
| 3,696,737 | 10/1972 | Wikner | 100/233 |
| 4,164,178 | 8/1979 | Baumann | 100/223 X |

FOREIGN PATENT DOCUMENTS

| | | | |
|---|---|---|---|
| 794551 | 2/1936 | France | 100/240 |

*Primary Examiner*—Billy J. Wilhite

*Attorney, Agent, or Firm*—Sughrue, Mion, Zinn, Macpeak and Seas

[57] ABSTRACT

A container closed by a lid for receiving and compacting waste paper includes a volume-occupying lid (3, 14) which fits inside the container (1, 13). The container (1, 13) defines a chamber large enough to accomodate individual pieces of waste to be deposited and compacted. The lid (3, 14) is retained in the container-closing position.

2 Claims, 14 Drawing Figures

COMPACTING WASTE BASKET

BACKGROUND OF THE INVENTION

The invention relates to a container for receiving and compacting waste, particularly waste paper. The container can also be used for other easily compacted waste such as packages of thin metal, cardboard or plastic.

Until now, waste has been thrown into a rigid container, a wire basket, or a suspended plastic sack. Some of these containers are open and others are provided with a lid or cover. All such waste containers can hold only relatively small amounts of waste, because it cannot be compacted. The disadvantage of this is that the waste containers must be frequently emptied, and that those containers used in public are often overfull since they can't be emptied often enough, and as a result waste is strewn around the ground next to the container. This is particularly true of waste containers provided in many public restrooms for paper hand towels.

There are, in addition, known devices for compacting the waste in a container (German OS No. 19 23 396 or U.S. Pat. No. 3,696,737), in which, as a rule, a compacting plate is moved inside the container by a very complicated and, thus, costly and malfunctionprone mechanism to simultaneously compact the entire contents of the container under great force. These known devices cannot, however, satisfactorily solve the overflow problem in public containers, because on the one hand a container cannot hold an adequate amount of waste and on the other hand special operation procedures must be carried out by trained personnel to compact the contents of the container.

SUMMARY OF THE INVENTION

The object of the present invention is to avoid the deficiencies of the known containers by providing a simply operated container of the type described above which can contain a quantity of waste normally many times the volume of the container itself.

The invention provides a means for achieving this object by providing a container lid which enters the container as it closes, the container having a volume adequate to accomodate individual pieces of waste material to be thrown in and compacted, and said lid being retained when in its container-closing position. With a lid constructed according to the invention, the compacting process begins as soon as the loosely layered waste fills the container to the bottom of the closed lid. Each additional piece which is thrown into the space taken by the lid when the container is closed is individually compacted by the lid as it closes and subsequently pressed into the container. Only relatively little pressure is needed. Due to the retension of the lid when the container is closed, the compacted waste must remain in the prescribed volume of the container. Within a short time the inner tension of the waste relaxes so that it no longer springs back when the lid is reopened. Thus, when the lid is opened, an empty space corresponding to the shape of the lid remains in the upper portion of the waste container, into which new, uncompacted waste items can be thrown. These are then compacted by the subsequent closing motion of the lid. Waste many times the normal volume of the container, e.g., ten times, can be held in a container according to the invention.

In one embodiment of the container the closing motion of the lid, which pivots about a horizontal axis, is guided by a device which causes increased compacting pressure of the lid on the waste as the lid moves from the open to the closed position.

The lid of one embodiment can be operated by means of the upper thigh or the hips. This type of body operation is hygenic since there is no skin contact with the container or lid during use, and this requires only relatively little expense for construction modification. Body operation, therefore, combines the advantages of the prior known customary hand operation which is also simple in construction, and foot operation which is hygenic, without including the disadvantages of these known types of operation, i.e., hand operation is relatively unhygenic and foot operation is relatively expensive to construct.

The space requirements of the lid mechanism in another embodiment vary, depending on the position of the lid mechanism, such that the lid mechanism takes up enough space in its closed position to accomodate the space requirements of the individual pieces of waste material to be thrown in and compacted, and a smaller minimal amount of space in its open position. This embodiment is particularly well suited for small containers, since the space requirements of the lid mechanism decrease when the lid is moved from the closed to the open position, and yet a sufficiently large space remains to accomodate waste even in containers of the smallest dimensions.

One economical embodiment of the container according to the invention has a lid, an operating mechanism, and a device for retaining the lid in the closed position, all manufactured as a single injection-molded element.

Another container embodiment has a funnel-shaped device to receive waste and a device operated from the outside for forcing the waste through the funnel-shaped receptacle into the interior of the container.

DETAILED DESCRIPTION OF THE PREFERRED EMBODIMENTS

Figure 2:
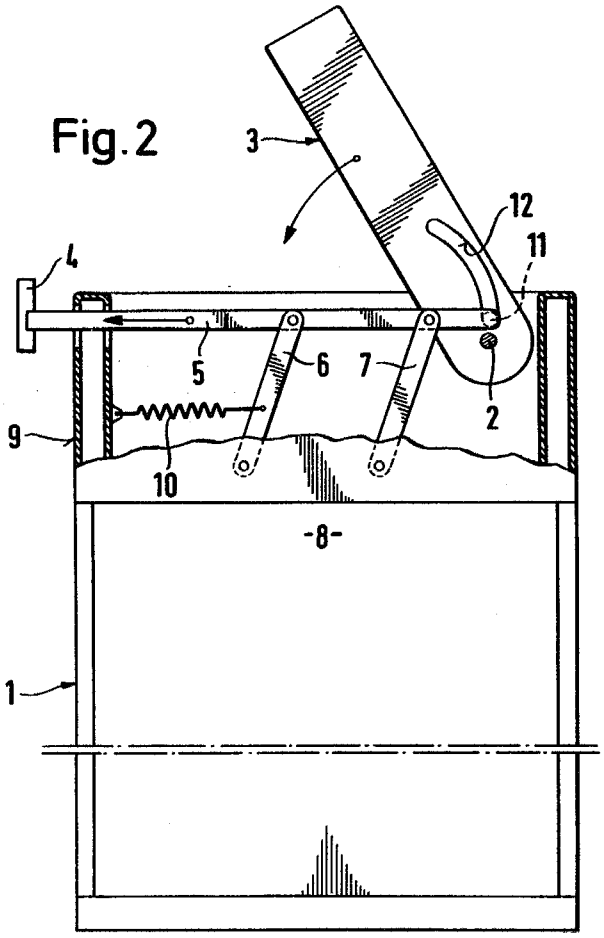
FIG. 2 is a side view of the container of FIG. 1 in its open position.
Figure 1:
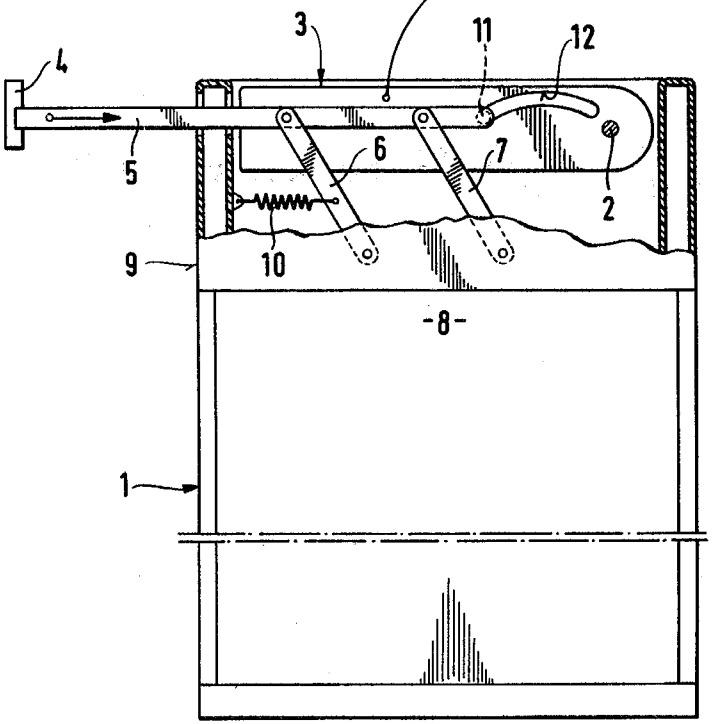
FIG. 1 is a schematic, partially cut away side view of a container according to the invention in its closed position.

FIGS. 1 and 2 show a container 1 with a lid 3, mounted so as to pivot about a horizontal axis 2. A bar 4 which preferably extends essentially across the entire width of the container is arranged on the front side thereof. The bar 4 is individually connected at its ends to a pair of horizontal bars 5, at least one of which is connected to two pivoting arms 6, 7 attached to the container side wall 8 so as to move in the direction of the arrow. A tension spring 10 is disposed between the forward pivoting arm 6 and the front wall 9 of the container. A follower 11 is situated at the back end of the bar 5. The follower 11 engages a curved slot 12 in the side wall of the lid 3.

In operation, as the bar 4 is pushed in the direction of the arrow, preferrably with the help of the thigh or the hips, the follower 11 swings the lid 3 into the opened position as it follows its track in slot 12. The waste is then deposited in the container and the bar 4 is released. The extended tension spring 10 pulls the lid 3 automatically into the closed position as shown in FIG. 1. The shape of the slot 12 assures that the closing motion of the lid 3 is essentially completed after only a relatively short return movement of bars 5 and 4. The latter and shorter portion of this closing motion of the lid 3, during which the waste compacting essentially takes place if the waste has already accumulated to the lower side of the lid, occurs during the longer portion of the return movement of the bar 4. This causes increased compacting force as the lid 3 closes. Many people might find the body operation more comfortable than foot operation, since more force can be brought to bear by a person standing on both feet and pushing with the body than by a person standing on one foot and pushing with the other. Furthermore, body operation is advantageous in that the body cannot be drawn back as quickly as the foot, thereby causing the lid to move into the closed position more slowly and with less noise, especially when the container is still relatively empty.

The container makes possible a simple direct transfer of the operation movement of the lid. The upper part of the container with the lid and its operating mechanism may comprise a single unit which can be adjusted to actual capacity, thus facilitating maintenance and transport. Tests have shown that the compacting process with paper towels can also be successfully carried out when numerous paper towels are simultaneously thrown into the compacting area formed by the lid in the closed position. The automatically returning lid at first appears to stop half way to the closed position. The lid closing speed varies depending on the amount of paper to be compacted at the same time. In extreme cases the compacting process can last up to several minutes. The capacity of this container is unexpectedly large, as has been shown in practical tests.

Figure 3:
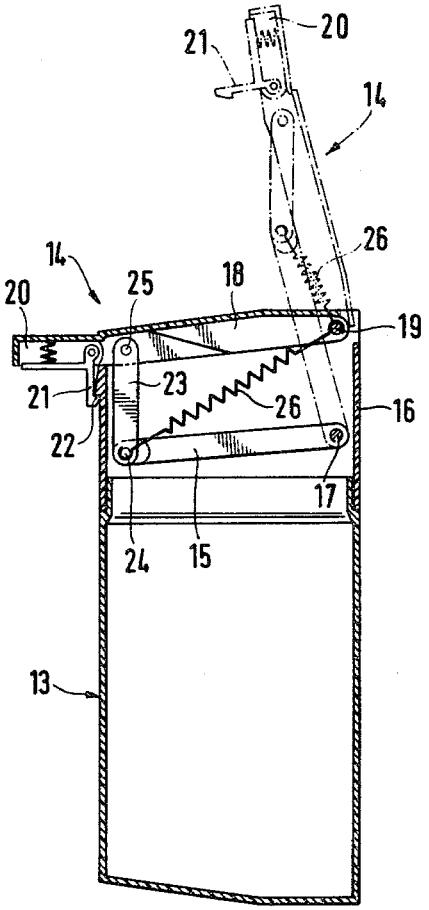
FIG. 3 is a schematic longitudinal section through another container embodiment in closed and opened positions (indicated by dotted lines)
Figure 4:
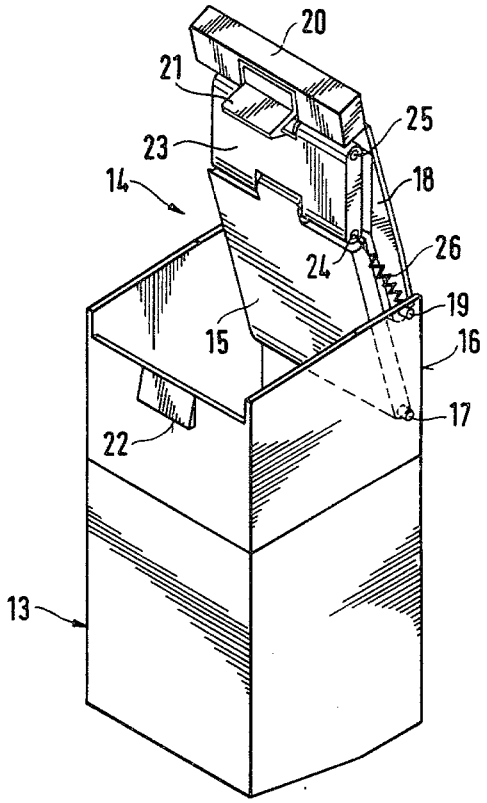
FIG. 4 is a perspective view of the container of FIG. 3 in the open position.

FIGS. 3 through 5 show a container 13 with a lid assembly 14. The lid assembly consists of a lower compactor plate 15 pivotably connected about an axis 17 near the interior of the rear wall 16 of the container and spaced from the upper end of the container, and of an upper closure lid 18 arranged parallel to the compactor plate 15. The closure lid 18 is also pivotably connected near the interior of the rear wall 16 about an axis 19. A hand grip 20 for operating the lid assembly 14 and a latch 21 are provided on the front side of the closure plate 18. These make contact with a projection 22 to retain the lid when in the closed position as shown in FIG. 3 by solid lines. The two plates 15 and 18 are connected in the front area by a lever assembly 23 which can consist of two bars or a plate. The lever assembly 23 allows the two plates to rotate relative to each other. The mounting axes 17 and 19 of plates 15 and 18, and the pivotal axes 24 and 25 of lever assembly 23, form the corner points of a collapsable parallelogram. A tension spring 26 is disposed between the axes 19 and 24.

Figure 5A:
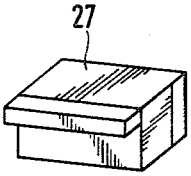
FIG. 5*a* is a schematic view in perspective of a unit which contains the lid mechanism according to FIGS. 3 and 4.
Figure 5B:
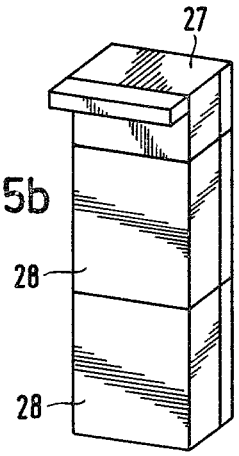
FIG. 5*b* is a schematic view in perspective as in FIG. 5*a* with two container modules.

In operation, the user grasps the hand grip 20 and disengages the retension mechanism 21, 22 by pivoting the hand grip slightly clockwise as seen in FIG. 3. Then the lid assembly 14 is automatically swung into the open position by the tension spring 26 as shown by dotted lines in FIG. 3 and in perspective in FIG. 4. In this position the container's deposit opening is very large as compared to that of a thick, rigid lid like that shown in FIGS. 1 and 2. After the paper has been deposited the hand grip 20 is again grasped and swung down against the force of the tension spring 26 until the locking mechanism 21, 22 is closed. The container 13 can have extremely small dimensions without restricting the depositing and compacting of waste. This type of small container, e.g., only 13 cm deep and 16 cm wide, can be used for example in private lavatory installations. As an example, the lid assembly 14 can be housed in a special unit 27, as shown in FIG. 5*a*, and be screwed to a wall. The actual container is hung on this unit 27 so that several modules 28 can be arranged one above the other, as shown in FIG. 5*b*.

Figure 7:
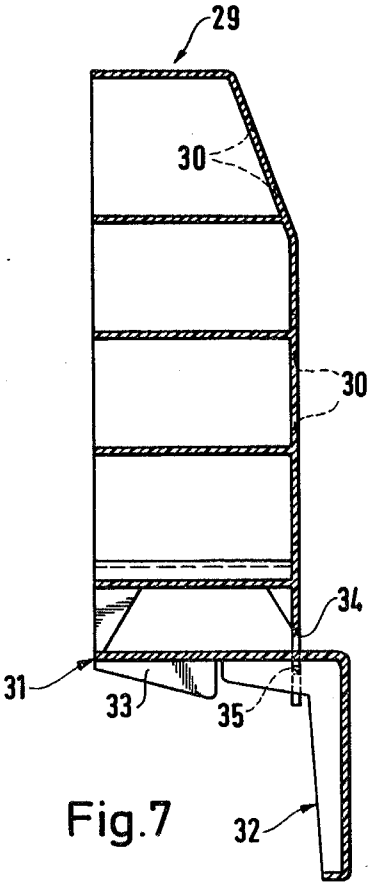
FIG. 7 is a section along the line VII—VII in FIG. 6.
Figure 6:
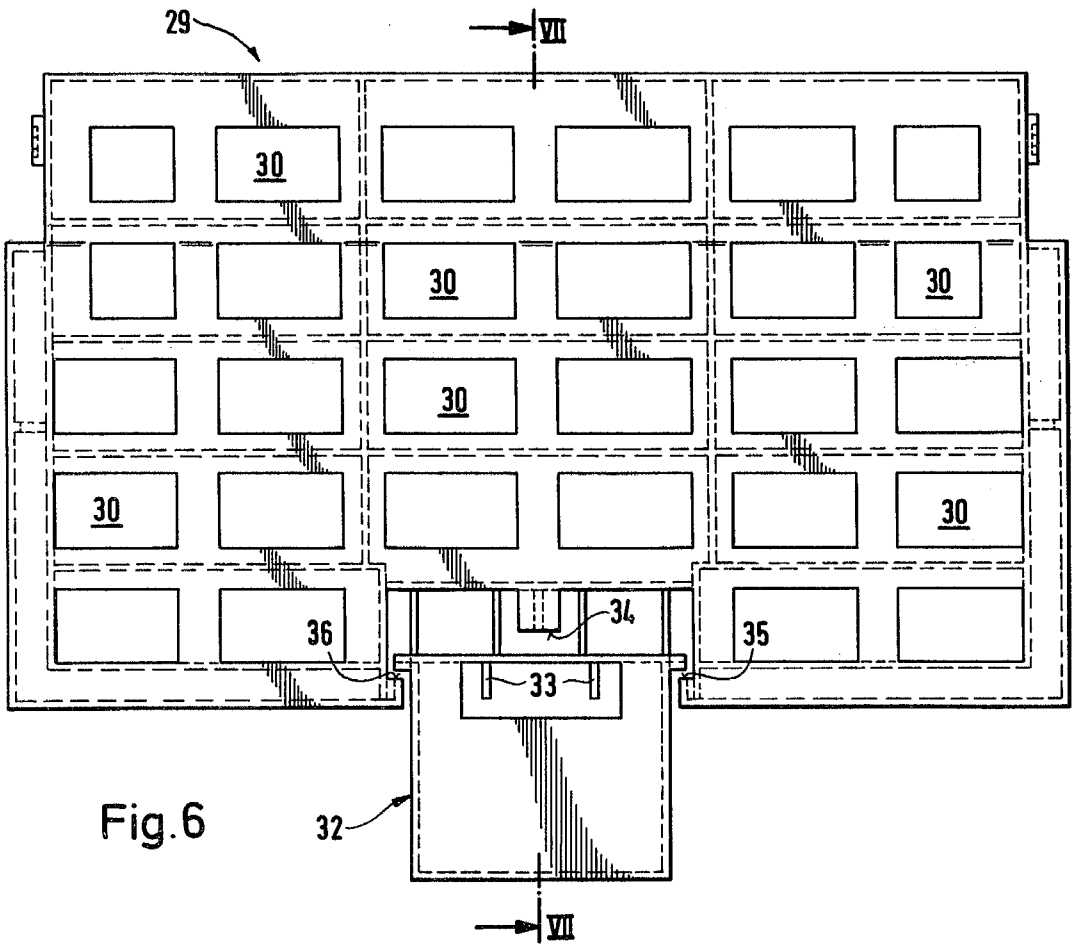
FIG. 6 is a top view of a one-piece injection-molded device, consisting of a lid, its operating mechanism, and a part of the mechanism which retains the lid.

FIGS. 6 and 7 show a grid-shaped compactor lid 29 having openings 30 for a design adapted to a cage-like waste basket. This lid could also be completely closed on its top or bottom side. In the event the bottom side is open, as shown in this exemplary embodiment, the grid size must be adapted to the size of the waste, i.e., the bottom side of the lid must be able to compact the waste into the interior of the container when the lid is in the closed position. A hand grip 32 is provided on the front side of the lid 20, which is connected to the lid by means of a flexible L-shaped connecting element 31. A latch 33 is located on the outside of the vertical shank of the connecting element 31. The latch 33 makes contact with a projection on the container when the container is closed and thus locks the lid. This locking is released by lightly pushing the hand grip 32 or the vertical shank of the connecting element 31 inward as the lid 29 is opened. To prevent damage to the connecting element 31, the backward or forward movement of the vertical shank of the connecting element is limited by stops 34, 35 or 36 on the container. The lid 29 together with its operating mechanism 31, 32 and the latch 33 of the locking assembly can be very economically produced as a single unit by injection molding.

FIGS. 8 through 12 shown embodiments of the container in which waste is accepted by a funnel-shaped device, means operated from the outside forces the waste into the container, and the waste is retained inside the container.

Figure 8:
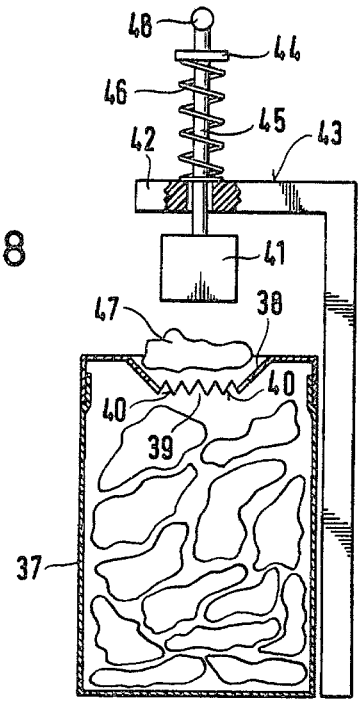
FIG. 8 is a schematic longitudinal section of another container embodiment having a funnel-shaped lid and a plunger which moves through the funnel opening.

FIG. 8 shows a container 37 with a stationary funnel-shaped lid 38. The funnel opening 39 includes teeth 40 directed into the container which prevent deposited waste from escaping. A plunger 41 is located above the funnel 38 and is held vertical by a guide assembly 42. A compression spring 46 is located between the upper side 43 of the guide assembly 42 and a stop washer 44 on plunger shaft 45. In operation, a piece of paper 47 is thrown into the funnel 38. The plunger 41 is then pushed straight down by pushing a knob 48 against the resistance of the compression spring 46 through the funnel opening 39, whereby the piece or paper 47 is pushed into the container and the knob 48 is released. The plunger 41 is automatically returned to the starting position shown in FIG. 8 by the return force of the compression spring 46. Whenever there is sufficient paper in the container 37 to create a corresponding upward return force, the retainer teeth 40 prevent paper from moving back through the funnel opening 39.

Figure 9:
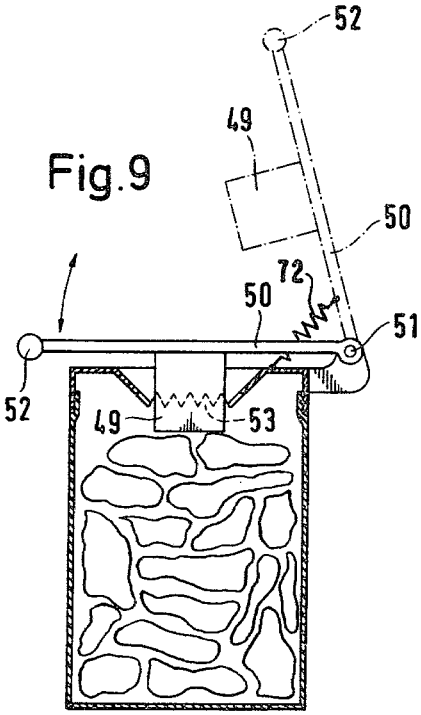
FIG. 9 is a schematic longitudinal section of a container as in FIG. 8 with a modified plunger.
Figure 10:
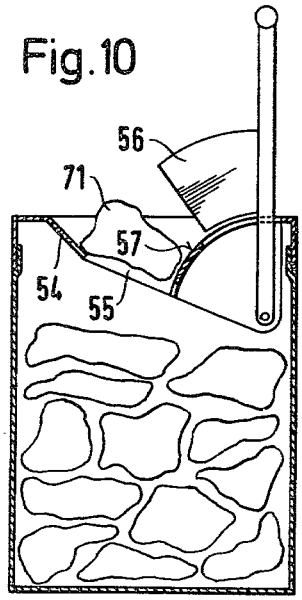
FIG. 10 is a schematic longitudinal section of a container similar to the embodiments shown in FIGS. 8 and 9 with a modified funnel and modified plunger.

Two slightly modified embodiments of this type container are shown in FIGS. 9 and 10. In FIG. 9 a plunger 49 is connected to a lever 50 which is pivotably mounted about an axis 51. The plunger 49 is moved in an arc into the funnel opening 53 (shown by solid lines) by moving the lever 50 counterclockwise by means of a knob 52. After the knob 52 is released, a spring 72 automatically returns the lever 50 to the original position shown by dotted lines. FIG. 10 shows an asymmetrical funnel 54 with a funnel opening 55. The asymmetric arrangement facilitates the depositing of pieces of paper 71 into the funnel. A plunger 56 moves similarly to the plunger shown in FIG. 9, i.e., in an arc along the funnel surface 57, which is also arched, into the funnel opening 55. The funnels and plungers shown with the containers in FIGS. 8–10 can have round or rectangular cross sections.

Figure 11:
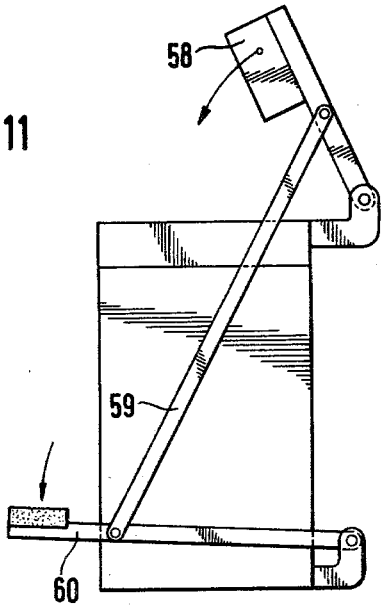
FIG. 11 is a side view of a container according to FIGS. 8 through 10 with a foot operated plunger.

FIG. 11 shows an embodiment of this type of container in which a plunger 58 can be rotated by means of a bar 59 and a foot pedal 60.

Figure 12:
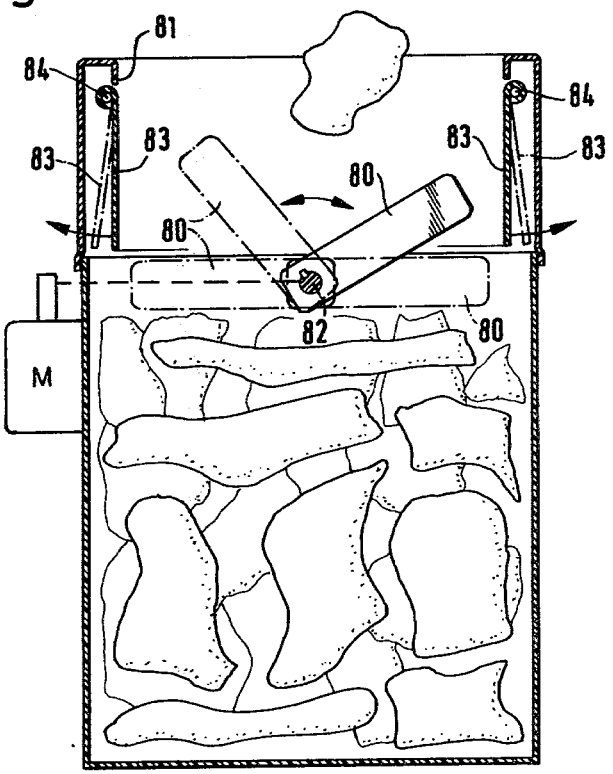
FIG. 12 is a schematic longitudinal section of a container having a lid formed as a plunger.

FIG. 12 shows an embodiment of this type of container in which a plunger 80, formed as a lid, is pivotably connected about a horizontal axis 82, located in the funnel 81. A drive mechanism located outside of the funnel 81, e.g., an electric motor M, oscillates the lid-shaped plunger 80 through 180°, as indicated by the double arrow, from one horizontal position to the other. Here a piece of waste thrown into the funnel 81, is caught by the plunger 80 and forced into either the left or the right half of the container, depending on the position of the plunger 80 at the moment the waste is thrown in. To prevent damage with the motor-driven plunger 80 if solid objects or body parts are wedged between the plunger and the funnel wall, the funnel walls situated parallel to the axis 82 are formed as flaps 83, pivotably connected about axes 84. These flaps 83 give way if a rigid object gets caught between them and the plunger 80. An electric switch, activated by an axis 84 associated therewith, changes the motor direction to expel the object.

Figure 13:
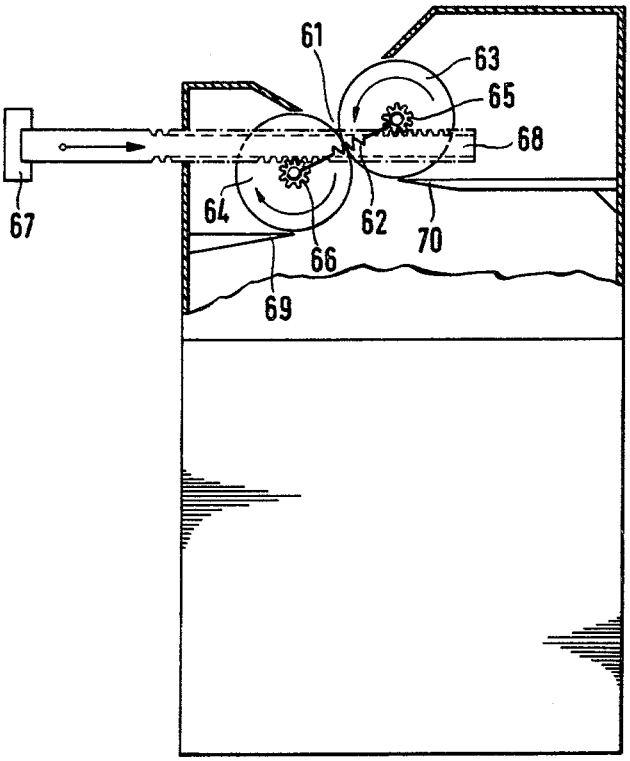
FIG. 13 is a schematic partially cut-away side view of another container embodiment.

In the embodiment shown in FIG. 13, the funnel-shaped waste receiving device is formed by the nip 61 between two drums 63 and 64, held together by a tension spring 62. On the axial ends of the vertically off set, adjacent drums 63 and 64, pinions 65 and 66 are immovably attached to the drums. The pinions engage a horizontally movable rack 68 connected to a bar 67 on the outside of the container. The piece of paper caught in the drum nip 61 is forced into the container by the wringer action of the drums 63 and 64 as shown by the arrows. The drums are driven by horizontal movement of the bar 67 to the right as in FIG. 13 by means of the rack and pinion assembly 68, 66, 65. Scrapers 69, 70 remove any paper adhering to the outer surface of the drums and force it into the container. Subsequently, the bar 67 is released, and the rack is returned to its original position by means of a spring (not shown). A free-wheeling mechanism in the mounting assemblies of the pinions 65 and 66 prevents the drums 63, 64 from being driven on the return stroke of the rack 68.

We claim:

1. A container for waste paper or the like, comprising:

(a) waste compacting means in the form of a pivotally mounted lid which fits into said container and occupies a volume in said container large enough to accommodate individual waste pieces to be deposited and compacted in said container, (b) means for retaining said lid in the closed position, (c) a transversely extending and horizontally movable bar (4) located on a front side of the container (1) and operated by a clothed part of the body, (d) a pair of horizontal bars (5) individually disposed on opposite sides of the container, each horizontal bar extending outwardly at one end from a front wall of the container (9), and each horizontal bar being connected at said one end to said movable bar, (e) at least one articulated swinging arm (6, 7) pivotably connected at one end to a side wall of the container and at the other end to one of the horizontal bars (5), and (f) means connecting the other ends of said horizontal bars to said lid.

2. Container according to claim 1, further comprising a device (11, 12) which controls the closing movement of said lid (3) about a horizontal axis (2) and creates an increasing compacting force by the lid on the waste as the lid is moved from the opened to the closed position.

* * * * *